US005505451A

United States Patent [19]

Brayshaw

[11] Patent Number: 5,505,451

[45] Date of Patent: Apr. 9, 1996

[54] SIMULATED GOLF PUTTING GREEN

[76] Inventor: Robin A. Brayshaw, The Mount, 23 Longlands Avenue, Coulsdon, Surrey CR5 1QY, England

[21] Appl. No.: 346,686

[22] Filed: Nov. 30, 1994

[51] Int. Cl.[6] ..... A63B 69/36

[52] U.S. Cl. ..... 273/176 H; 273/176 F

[58] Field of Search ..... 273/176 R, 176 B, 273/176 E, 176 F, 176 FB, 176 H, 178 R, 178 B, 179 R, 176 A, DIG. 31, 441, 118 R

[56] References Cited

U.S. PATENT DOCUMENTS

| | | | |
|---|---|---|---|
| 1,612,291 | 12/1926 | Jackson | 273/178 B |
| 1,612,292 | 12/1926 | Jackson | 273/178 B |
| 2,465,418 | 3/1949 | Baker | 273/176 H |
| 3,424,463 | 1/1969 | Matthews | 273/176 F |
| 3,434,721 | 3/1969 | Travers | 273/176 F |
| 3,508,756 | 4/1970 | Bedford, Jr. | 273/176 H |
| 3,892,412 | 7/1975 | Koo | 273/178 B |
| 5,082,280 | 1/1992 | Wang | 273/176 H |

FOREIGN PATENT DOCUMENTS

| | | |
|---|---|---|
| 250884 | 4/1926 | United Kingdom . |
| 468572 | 7/1937 | United Kingdom . |
| 1199622 | 7/1970 | United Kingdom . |
| 1283461 | 7/1972 | United Kingdom . |
| 2147814 | 5/1985 | United Kingdom . |
| 2147507 | 5/1985 | United Kingdom . |

*Primary Examiner*—Vincent Millin
*Assistant Examiner*—Steven B. Wong
*Attorney, Agent, or Firm*—Gottlieb, Rackman & Reisman

[57] ABSTRACT

A simulated golf putting green comprises a substantially rigid base portion which slopes in a direction of its axis from a high back end to a low front end of substantially no height, the base portion being additionally contoured about the direction of its axis so that it slopes downwardly from a central portion towards both side edges, the base portion defining at least three holes located at spaced positions across the width in the back higher half of the base portion, one of the holes being substantially at the top of a central flat portion about the axis. The green includes an elongate, flexible cover sheet, one end of which substantially covers the base portion and the major free end part of which extends beyond the lower front end of the base portion, the cover sheet also defining the holes.

5 Claims, 2 Drawing Sheets

SIMULATED GOLF PUTTING GREEN

This invention relations to a simulated golf putting green intended to be used indoors for practising putting.

Several indoor putting greens are already known, for example Patent GB 1199622 and U.S. Pat. No. 3,892,412 disclose greens formed with a flexible surface and complicated structures of inflatable bags or hydraulic jacks beneath the flexible surface which can be used to vary the shape of the green around a single hole. Such arrangements are expensive, complicated and require a lot of space to store when not in use.

Patent GB 2147814 shows a green having a wedge sloped in one direction with a single hole, the wedge being surrounded by a return ball track.

Patent GB 2147507 discloses a green comprising a flat plate with a single hole, the plate being tiltable about two horizontal axes at rights angles to one another.

Patent GB 1283461, which is regarded as the closest prior art, shows a rigid wedge shaped base with a flexible cover sheet extending beyond it. It is formed with two spaced holes but is not contoured about the longitudinal axis and has no ball return.

The present invention provides a golf putting green comprising a substantially rigid, base portion which slopes in one longitudinal direction from a higher end to a lower end of substantially no height, (and preferably an elongate flexible simulated grass cover sheet, one end of which substantially covers the base portion and the major free end part of which extends beyond the lower end of the base portion), the base portion (and cover sheet if present) defining at least one hole located nearer the higher end than the lower end of the base portion, characterised in that the base portion is additionally contoured about the longitudinal axis so that it slopes downwardly from a central portion towards both side edges, there are at least three holes located at different positions across the width of the base, one of which is preferably substantially at the top of the contour about the longitudinal axis, and in which the base is preferably shaped such as not to allow any ball to come to rest thereon, at least over the back half thereof.

Because of the slope and the contoured shape about the longitudinal axis, such a green has the alternatives of a straight putt and different left and right breaks around the holes, which breaks are different depending on where the ball is initially placed in relation to the holes.

The green is light and relatively cheap to make and the free end of the cover sheet can be rolled up when not in use so that the green can be stored in a space not substantially greater than the base portion.

One embodiment of golf putting green will now be described, by way of example only, with reference to the accompanying drawings, of which:

Figure 1:
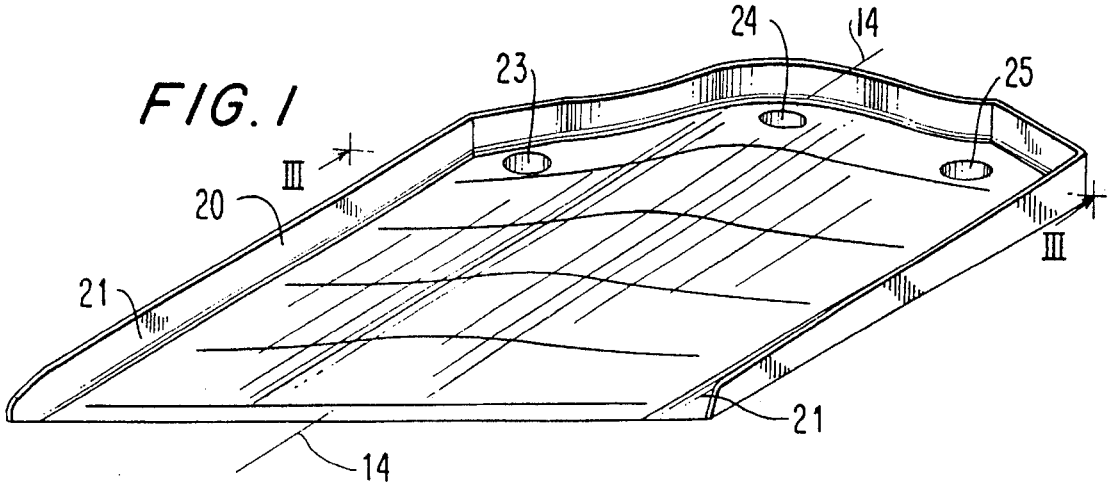
FIG. 1 is a perspective view of a base portion of the green.
Figure 2:
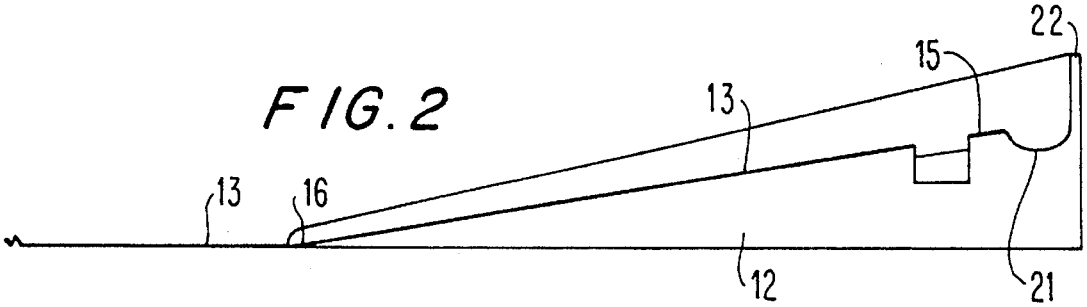
FIG. 2 is a diagrammatic side view of the green.
Figure 3:
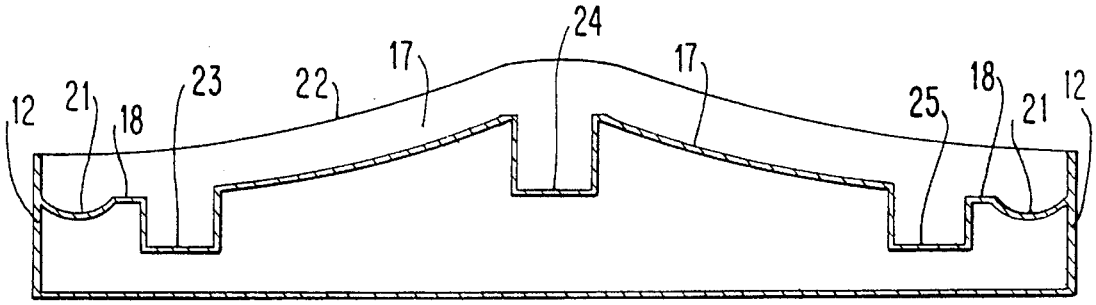
FIG. 3 is a sectional view on the line III—III of FIG. 1.
Figure 4:
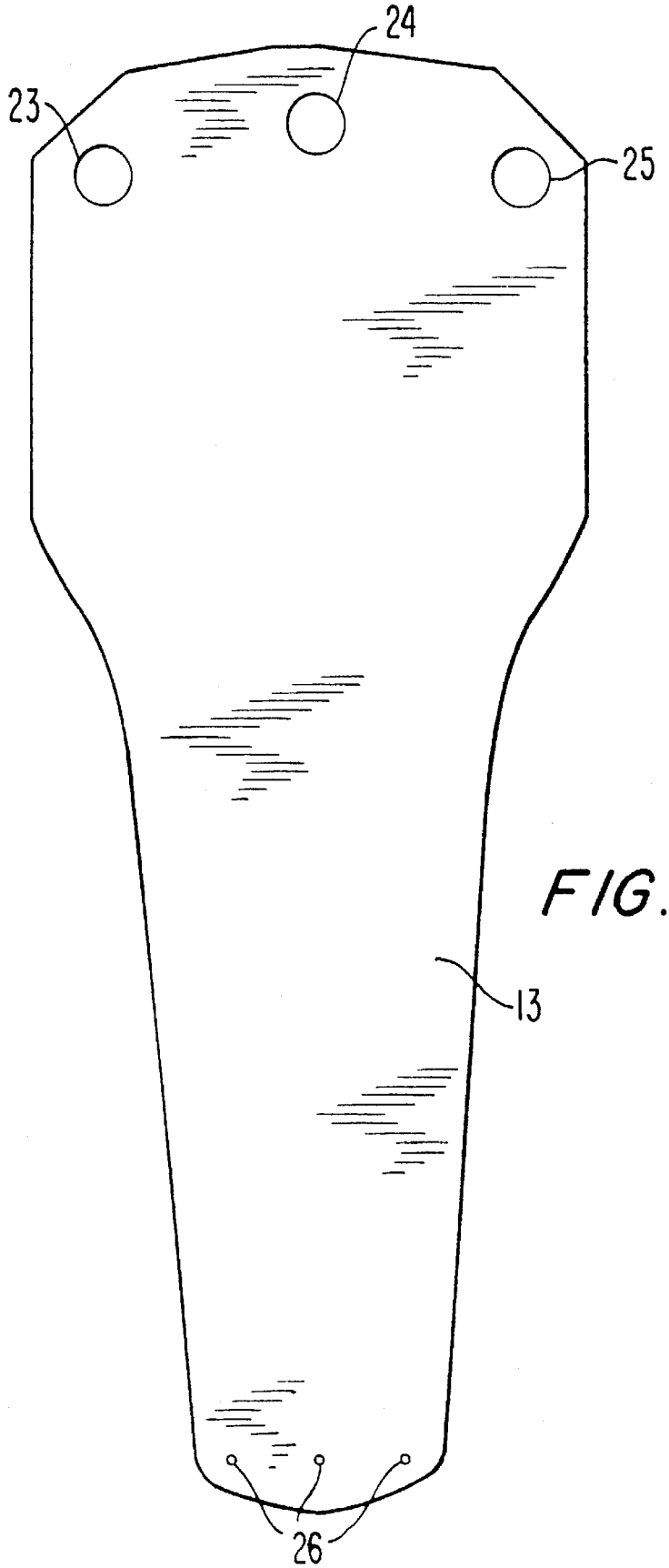
FIG. 4 is a plan view of the cover sheet.

The green comprises a moulded, preferably plastics material, substantially rigid, shaped base portion 12 and a flexible cover sheet of simulated grass, fabric material 13. The base 12 is of wedge shape, in side view as seen in FIG. 2, parallel to its longitudinal axis 14 so that it has a higher end 15 and a lower end 16 of substantially no height. As seen in FIG. 3 the base portion is also contoured or shaped about the longitudinal axis so that it has a central higher portion 17 which is flat about the longitudinal axis for about 2 inches (5 cms) width and then slopes down towards each of its sides 18. The base includes a ball return track 20 formed by a gulley 21 and an outer upstanding wall 22 extending right round its higher end 15 and the sides 18. The gulley is sloped down towards the lower end 15 so that balls will not remain on the base portion but will run down into the gulley and roll downhill substantially in the longitudinal direction away from the base.

The cover 13 has one end which extends over and covers the base portion apart from the gulley but the majority of which extends as a free end beyond the lower end 16 of the base portion.

The base portion and cover sheet are formed with three holes 23, 24 and 25 adjacent the upper end and spaced across the width of the green. The central hole is at the top of the flat area including the longitudinal axis.

In use a golf ball can be placed at different positions, as indicated at 26, on the cover sheet adjacent its free end and this provides the alternative of a straight put and a large variety of different left and right breaks towards the different holes.

I claim:

1. A simulated golf putting green comprising a substantially rigid base portion (12) which slopes in a direction of its axis (14) from a high back end (15) to a low front end (16) of substantially no height, characterized in that the base portion is additionally contoured about the direction of its axis so that it slopes downwardly from a central portion (17) toward both sides (18), the base portion defining at least three holes (23, 24, 25) located at spaced positions across the width in the back higher half of the base portion;

wherein the central portion (17) is flat about the longitudinal axis for at least the width of a golf ball and one of the holes is in the central portion.

2. A green according to claim 1 including an elongate, flexible cover sheet (13), having one end which substantially covers the base portion (12) and a major free end part of which extends beyond the lower front end (16) of the base portion, the cover sheet also defining the holes.

3. A green according to claim 2 in which the cover sheet is of a material to simulate grass.

4. A green according to claim 1 in which the base is sloped so that a golf ball located on substantially any part of it will roll off.

5. A green according to claim 1 including a ball return track (21) formed by a gulley located around the back and sides of the base and sloped downwardly towards the front.

* * * * *